US005900224A

United States Patent [19]

Fujimura et al.

[11] Patent Number: 5,900,224

[45] Date of Patent: May 4, 1999

[54] METHOD FOR TREATING WASTES BY GASIFICATION

[75] Inventors: Hiroyuki Fujimura, Tokyo; Yoshio Hirayama, Zushi; Shosaku Fujinami, Tokyo; Shuichi Nagato, Yokohama; Tetsuhisa Hirose, Tokyo; Takahiro Oshita, Yokohama; Masaaki Irie; Kazuo Takano, both of Tokyo; Toshio Fukuda, Yokohama, all of Japan

[73] Assignees: Ebara Corporation, Tokyo; Ube Industries, Ltd., Ube, both of Japan

[21] Appl. No.: 08/757,452

[22] Filed: Nov. 27, 1996

[30] Foreign Application Priority Data

| | | | |
|---|---|---|---|
| Apr. 23, 1996 | [JP] | Japan | 8-123938 |
| Jul. 15, 1996 | [JP] | Japan | 8-202775 |
| Sep. 4, 1996 | [JP] | Japan | 8-252263 |

[51] Int. Cl.[6] ..... C01B 3/02; C01B 3/12; C01C 1/04

[52] U.S. Cl. ..... 423/359; 48/197 R; 48/197 A; 48/DIG. 2; 252/373; 423/648.1; 423/656; 588/226

[58] Field of Search ..... 588/226; 423/648.1, 423/359, 656; 252/373; 48/197 R, 197 A, DIG. 2

[56] References Cited

U.S. PATENT DOCUMENTS

| | | | |
|---|---|---|---|
| 3,304,249 | 2/1967 | Katz | 423/DIG. 16 |
| 3,759,677 | 9/1973 | White | 423/648.1 |
| 3,823,227 | 7/1974 | White | 252/373 |
| 4,242,458 | 12/1980 | Child et al. . | |
| 4,419,330 | 12/1983 | Ishihara et al. . | |
| 4,452,155 | 6/1984 | Ishihara et al. . | |
| 4,497,637 | 2/1985 | Purdy et al. | 252/373 |
| 4,778,483 | 10/1988 | Martin et al. . | |
| 4,936,872 | 6/1990 | Brandl et al. | 252/373 |
| 5,311,830 | 5/1994 | Kiss . | |

(List continued on next page.)

FOREIGN PATENT DOCUMENTS

| | | |
|---|---|---|
| 0 153 235 | 8/1985 | European Pat. Off. . |
| 0 126 961 | 12/1994 | European Pat. Off. . |
| 0 676 464 | 10/1995 | European Pat. Off. . |
| 0 676 465 | 10/1995 | European Pat. Off. . |
| 44 35 349 | 9/1994 | Germany . |
| 44 35 349 | 5/1996 | Germany . |
| 56-3810 | 1/1981 | Japan . |
| 60-11587 | 1/1985 | Japan . |

(List continued on next page.)

OTHER PUBLICATIONS

Abondoned U.S. Patent Application filed Nov. 27, 1996, entitled "Method And Apparatus For Treating Waste By Gasification", by Hiroyuki Fujimura, Serial No. 08/753,607.

Copending U.S. Patent Application filed Jun. 18, 1997, entitled "Method And Apparatus For Treating Waste By Gasification", by Hiroyuki Fujimura, Serial No. 08/877,810, Group Art Unit 1312.

Copending U.S. Patent Aplication filed Aug. 20, 1997, entitled "Method Of And Apparatus For Fluidized–Bed Gasification And Melt Combustion", by Yoshio Hirayama, Serial No. 08/915,322, Group Art Unit 1312.

(List continued on next page.)

*Primary Examiner*—Wayne Langel

*Attorney, Agent, or Firm*—Wenderoth, Lind & Ponack, L.L.P.

[57] ABSTRACT

A method and apparatus for treating wastes by gasification recovers metals or ash content in the wastes in such a state that they can be recycled, and gases containing carbon monoxide (CO) and hydrogen ($H_2$) for use as synthesis gas of ammonia ($NH_3$). The wastes are gasified in a fluidized-bed reactor at a relatively low temperature, and gaseous material and char produced in the fluidized-bed reactor are introduced into the high-temperature combustor. The synthesis gas is produced in the high-temperature combustor at a relatively high temperature, CO and $H_2O$ in the synthesis gas is converted into $CO_2$ and $H_2$, and then $H_2$ is recovered by removing $CO_2$.

33 Claims, 4 Drawing Sheets

U.S. PATENT DOCUMENTS

| | | | |
|---|---|---|---|
| 5,347,068 | 9/1994 | Rabe et al. | 588/226 |
| 5,425,317 | 6/1995 | Schaub et al. . | |
| 5,470,361 | 11/1995 | Linke et al. | 252/373 |
| 5,550,312 | 8/1996 | Schingnitz et al. | 252/373 |
| 5,620,488 | 4/1997 | Hirayama . | |
| 5,656,044 | 8/1997 | Bishop et al. | 48/197 R |
| 5,725,614 | 3/1998 | Hirayama . | |

FOREIGN PATENT DOCUMENTS

| | | |
|---|---|---|
| 60-158293 | 8/1985 | Japan . |
| 2-147692 | 6/1990 | Japan . |
| 7-332614 | 12/1995 | Japan . |
| 833551 | 4/1960 | United Kingdom . |

OTHER PUBLICATIONS

German Patent Publication No. DE 44 35 349 C1 and English translation thereof.

Shosaku Fujinami et al., "Fluidized–Bed Gasification of Cellulosic Wasts (1)", Ebara Engineering Review No. 151, Ebara Corporation, Japan, 1991, pp. 10–16, Includes English abstract.

Shosaku Fujinami et al., "Fluidized–Bed Gasification of Cellulosic Wasts (2)", Ebara Engineering Review No. 153, Ebara Corporation, Japan, 1991, pp. 18–24, includes English abstract.

Yoshjiaki Ishii et al., "Two–Bed Pyrolysis System for Municipal Refuse", Ebara Engineering Review No. 104, Ebara Corporation, Japan, 1978, pp. 3–10.

U.S. application Serial No. 08/753,607, filed Nov. 27, 1996, "Method And Apparatus For Treating Wastes By Gasification", Hiroyuki Fujimura et al., located in Group Art Unit 1312.

METHOD FOR TREATING WASTES BY GASIFICATION

BACKGROUND OF THE INVENTION

1. Field of the Invention

The present invention relates to a method and apparatus for treating wastes by gasification, and more particularly to a method and apparatus for treating wastes by gasification at a relatively low temperature and then at a relatively high temperature to recover metals or ash content in the wastes in such a state that they can be recycled, and gases containing carbon monoxide (CO) and hydrogen ($H_2$) for use as synthesis gas of ammonia ($NH_3$).

2. Description of the Prior Art

Ammonia ($NH_3$) is a basic material for chemical industries and is mass-produced for use in production of nitric acid, various fertilizers; including ammonium nitrate, ammonium sulfate and urea; acrylonitrile, caprolactam or the like. Ammonia is synthesized from nitrogen ($N_2$) and hydrogen ($H_2$) under a high pressure in the presence of a catalyst. Hydrogen ($H_2$) has been produced by either steam reforming of natural gas or naphtha, or partial combustion, i.e. gasification, of hydrocarbons such as petroleum, coal or petroleum coke.

It has heretofore been customary to treat organic wastes including municipal wastes, plastic wastes including fiber-reinforced plastics (FRP), biomass wastes, and automobile wastes by incineration to reduce the volume thereof, or to discard the organic wastes in an untreated state in landfill sites.

Therefore, a small quantity of useful resources has been recovered from the organic wastes and used for recycling, irrespective of direct or indirect utilization.

Hydrogen which is a material for ammonia ($NH_3$) is obtained from natural gas, naphtha, petroleum, coal or petroleum coke. Since most of those materials are dependent on importation from abroad, there has long been a need for a way of procuring materials which are inexpensive and available locally.

On the other hand, the incineration of solid wastes has been disadvantageous for the following reasons:

A stoker furnace or a fluidized-bed furnace has heretofore been used for the incineration of solid wastes. However, this incineration has been problematic with respect to environmental conservation, or recycling of resources or energy. To be more specific, large quantities of exhaust gas are discharged because of high air ratio, and toxic Dioxins are contained in the exhaust gas. Further, metals which are discharged from the furnace are not suitable for recycling because they are oxidized, and landfill sites become more scarce year by year. Recently, the number of waste treatment facilities which incorporate ash-melting equipment is increasing, however, a problem is encountered in construction cost and/or operating cost of such waste treatment facilities. Further, recently there has been developing a tendency to utilize energy of solid wastes efficiently.

Dumping solid wastes in an untreated state on the land has become more difficult because of scarcity of landfill sites, and has not been allowable from the viewpoint of environmental conservation. Therefore, there is no site where solid wastes such as shredder dust of scrapped cars can be disposed of.

SUMMARY OF THE INVENTION

It is therefore an object of the present invention to provide a method and apparatus for treating wastes by gasification which can recover resources of the wastes, open up a road to separation and reuse of the resources, produce synthesis gas having desired components for use for synthesis of ammonia by partial combustion, solve various problems caused by incineration or dumping of organic wastes, and obtain low cost hydrogen ($H_2$) which is used for synthesis of ammonia.

In order to achieve the above object, according to one aspect of the present invention, there is provided a method for treating wastes by gasification, comprising the steps of: gasifying wastes in a fluidized-bed reactor at a relatively low temperature; introducing gaseous material and char produced in the fluidized-bed reactor into a high-temperature combustor; producing synthesis gas in the high-temperature combustor at a relatively high temperature; quenching the synthesis gas produced in the high-temperature combustor; converting CO and $H_2O$ in the synthesis gas into $CO_2$ and $H_2$; and recovering $H_2$ by removing $CO_2$.

According to another aspect of the present invention, there is provided an apparatus for treating wastes by gasification, comprising: a fluidized-bed reactor for gasifying wastes at a relatively low temperature to produce gaseous material and char; a high-temperature combustor for producing synthesis gas at a relatively high temperature; a quenching chamber containing water for quenching the synthesis gas; a convertor for converting CO and $H_2O$ in the synthesis gas into $CO_2$ and $H_2$; and an absorber for absorbing $CO_2$ to recover $H_2$.

The gasifying steps in the fluidized-bed reactor and the high temperature combustor may be carried out under a pressure ranging from 10 to 40 atm. The recovered $H_2$ may be used for producing ammonia.

The method may comprise the step of separating air into oxygen and nitrogen, the separated oxygen being used for agent in the fluidized-bed reactor and the high-temperature combustor, and the separated nitrogen being used for producing ammonia.

The relatively low temperature in a fluidized-bed of the fluidized-bed reactor may be in the range of 450 to 650° C., and the temperature in a freeboard of the fluidized-bed reactor may be in the range of 600 to 800° C.

The relatively high temperature in the high-temperature combustor may be 1300° C. or higher.

In the gasification process, a mixture of oxygen obtained by separation of air and steam is used as a gasifying agent for producing hydrogen. Nitrogen obtained by separation of air is used for synthesis of ammonia ($NH_3$). The separation of air into oxygen and nitrogen is carried out by a low-temperature separation method (PSA), an adsorption method (TSA) or as membrane separation. By using oxygen enriched air as a gasifying agent, a mixture of hydrogen ($H_2$) and nitrogen ($N_2$) with a ratio of 3:1 can be generated, and the generated gas can be used for synthesis of ammonia ($NH_3$).

The apparatus may further comprise a scrubber provided downstream of the quenching chamber for removing dust and toxic gas such as HCl in the generated gas, a CO convertor for converting CO and $H_2O$ in the generated gas into $H_2$ and $CO_2$, an acid gas removing device for removing $CO_2$ and $H_2O$ after the CO shift conversion, and a reactor for reacting the refined $H_2$ with the refined $N_2$ to synthesize $NH_3$.

Further, it is desirable that the apparatus further comprises a separator for separating air into $N_2$ and $O_2$, means for introducing the separated $N_2$ into the reactor for synthesizing ammonia ($NH_3$), and means for introducing the separated $O_2$ into the fluidized-bed reactor and/or the high-temperature combustor.

The above and other objects, features and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
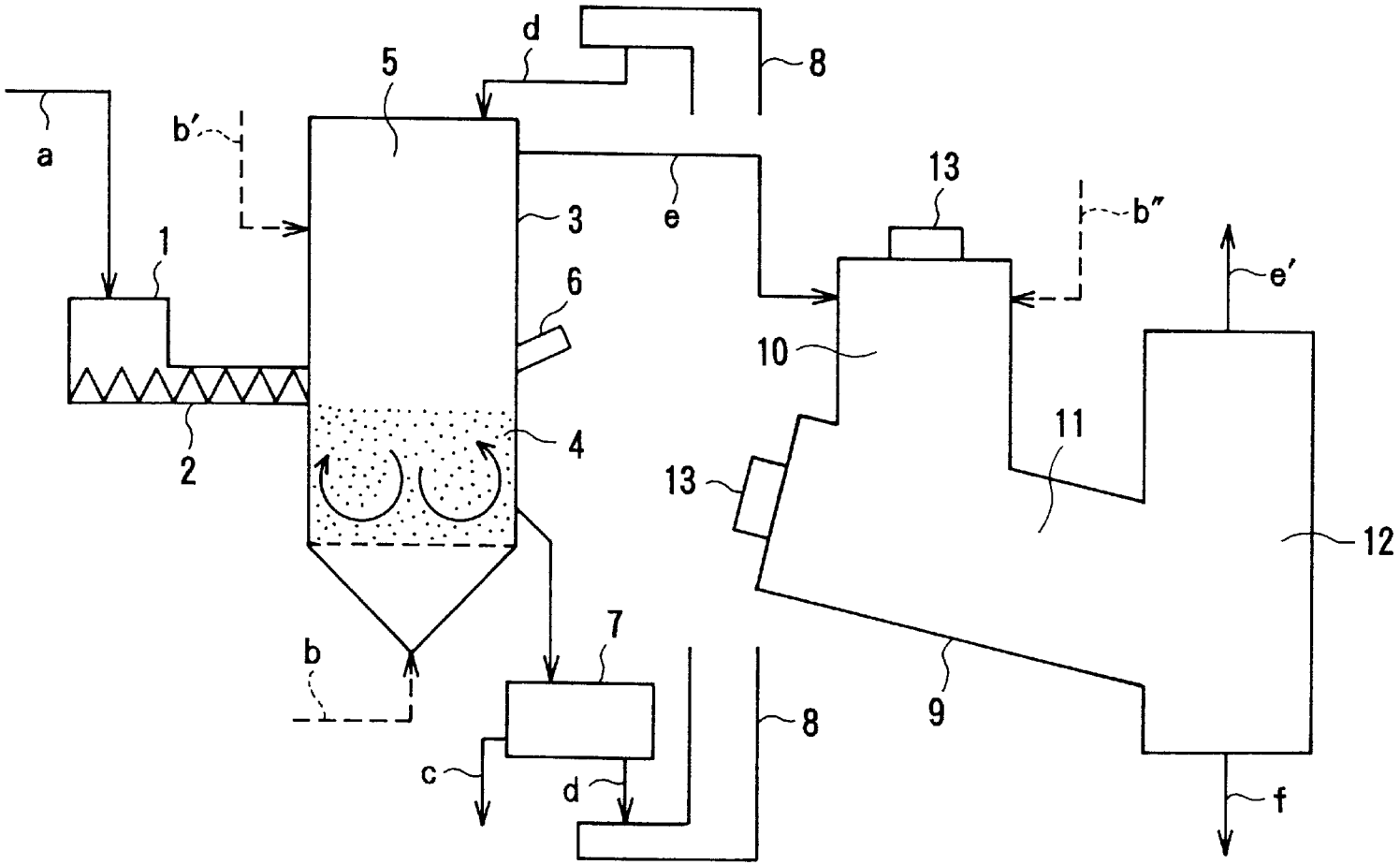
FIG. 1 is a schematic diagram of an apparatus for carrying out the treating method according to a first embodiment of the present invention.

A method and apparatus for treating wastes by gasification according to the present invention will be described below with reference to drawings.

Wastes which are used in the present invention may be municipal wastes, biomass wastes, plastic wastes including fiber-reinforced plastics (FRP), automobile wastes, low-grade coal, waste oil, and alternative fuels which are produced by solidifying or slurrying the above wastes.

The alternative fuels include refuse-derived fuel (RDF) which is produced by pulverizing and classifying municipal wastes, adding quicklime to the classified municipal wastes, and compacting them to shape, and solid-water mixture which is produced by crushing municipal wastes, converting them into a slurry with water, and converting it into an oily fuel by hydrothermal reaction. The biomass wastes include wastes generated from water supply or sewage plants (admixture, remnant, sewage sludges, or the like), agricultural wastes (rice husks, rice straw, surplus products, or the like), forestry wastes (sawdust, bark, lumber from thinning, or the like), industrial wastes (pulp-chip dust, or the like), and scrap wood from construction. The low-quality coal includes peat which has low degrees of coalification, or coal refuse which is produced upon coal dressing.

The present invention is also applicable to organic materials including oil shale, garbage, carcasses of beasts, waste clothing, waste paper, and any other material.

These wastes are first supplied into a fluidized-bed reactor and pyrolized therein. Particularly, by employing a revolving-type fluidized-bed reactor as the reactor, the wastes which have been coarsely crushed by pretreatment can be supplied to the fluidized-bed reactor. The reason is that by a vigorous revolving flow of the fluidized medium, good heat transfer to the supplied wastes can be obtained, and large-sized incombustibles can be discharged from the fluidized-bed furnace. The effects of the revolving flow of the fluidized medium will be described later in detail.

Therefore, among these wastes, the municipal wastes, the biomass wastes, the plastic wastes, and the automobile wastes are roughly crushed to a size of about 30 cm. The sewage sludges and night soil which have a high moisture content are dehydrated into a cake form by a centrifugal separator or the like in dedicated treatment facilities, and then the dehydrated cake is transported to a plant site which has a treating system of the present invention. The refuse-derived fuel, the solid water mixture, and the highly concentrated wastewater are used as they are. Coal added for calorie adjustment may be used as it is, if it is crushed to a size of 40 mm or less.

The above wastes may be roughly grouped into high calorific wastes and low calorific wastes according to their calorific values and their moisture contents. Generally, the municipal wastes, the refuse-derived fuel, the solid water mixture, the plastic wastes, the automobile wastes, and electric appliance wastes are high calorific wastes. The biomass wastes, the special wastes such as medical wastes, the dehydrated cake of sewage sludges and night soil, and the highly concentrated waste liquids are low calorific wastes.

These wastes are charged into a high calorific waste pit, a low calorific waste pit, and a tank, and sufficiently stirred and mixed in the pits and the tank. Thereafter, they are supplied to the fluidized-bed reactor. Metals contained in the wastes which are supplied to the fluidized-bed reactor are recovered in a non-corroded condition if their melting points are higher than the fluidized-bed temperature in the fluidized-bed reactor. Therefore, these recovered metals can be used as ingot metal in accordance with the type of metal.

If the wastes supplied to the fluidized-bed reactor have a constant quality, then the ratio of the wastes to the gas supplied to the fluidized-bed reactor for gasification is also constant. However, if the proportion of the low calorific wastes in the supplied wastes increases or the overall moisture content in the supplied wastes increases, then the temperature of the fluidized-bed tends to go down from a desired value. When the temperature of the fluidized-bed goes down, it is desirable to adjust the proportion of the low calorific wastes to the high calorific wastes in the supplied wastes to keep the calorific value of the supplied wastes constant from the viewpoint of gas utilization at a later stage. Alternatively, coal with a high calorific value may be added to adjust the calorie of the supplied wastes. Incidentally, oil coke may be added instead of coal to adjust the calorific value of the supplied wastes.

Next, a fluidized-bed reactor for gasifying wastes at a relatively low temperature according to the present invention will be described below. Using such a fluidized-bed reactor for gasifying wastes at a relatively low temperature is one of the features of the present invention.

Fluidized-bed reactors themselves are known as combustion or gasification furnaces. However, it is a novel feature of the present invention to use a combination of a fluidized-bed reactor and a high-temperature combustor for producing combustible gases.

There is a known technology in which coal is supplied into a high-temperature gasification furnace as pulverized coal or slurried coal with water. However, in case of wastes, it is not easy to pulverize them, compared with coal. Particularly, if the wastes contain incombustibles such as metals, debris, or stones, then it is almost impossible to pulverize the wastes or slurry the wastes. However, in case of using the fluidized-bed reactor, the wastes can be pyrolized in a coarsely crushing state to thus generate combustible gaseous materials and fine char. The generated gaseous materials and char are introduced into a subsequent high-temperature combustor in which they are gasified at a relatively high temperature. In the fluidized-bed reactor, the only necessary work is to convert the wastes into combustible gaseous materials and char by a slow reaction of thermal decomposition and gasification, thus the fluidized-bed in the fluidized-bed reactor can be kept at a relatively low temperature. The fluidized-bed reactor which can be used in the present invention may be a known atmospheric or pressurized fluidized-bed reactor including a bubbling-type fluidized-bed furnace, in consideration of characteristics of wastes to be treated. However, it is particularly preferable to use a revolving flow-type fluidized-bed reactor which has been developed by the inventors of the present invention.

The revolving flow-type fluidized-bed reactor preferably has a circular horizontal cross-section, and has a relatively mild fluidized-bed with a substantially low fluidizing gas rate in a central region and a relatively intensive fluidized-bed with a substantially high fluidizing gas rate in a peripheral region. The revolving flow-type fluidized-bed reactor has an inclined wall installed along an inner wall in the vicinity of the surface of the fluidized-bed, for deflecting the flow of the fluidized medium from the peripheral region toward the central region so that a revolving flow of the fluidized medium is formed in such a manner that the fluidized medium descends in the mild fluidized-bed, ascends in the intense fluidized-bed, moves from the central region toward the peripheral region in a lower portion of the fluidized-bed and moves from the peripheral region toward the central region in an upper portion of the fluidized-bed.

The revolving flow-type fluidized-bed reactor having a specific structure according to the present invention offers the following advantages:

1. Since the produced char is not accumulated on the fluidized-bed and is dispersed well and uniformly in the fluidized-bed, oxidization of char can be effectively carried out in the fluidized-bed, particularly in the intense fluidized-bed. Heat generated by oxidization of char is transferred to the fluidized medium, and the transferred heat can be effectively used as a heat source for thermal decomposition and gasification at a central portion of the fluidized-bed in the fluidized-bed reactor.

2. Since the fluidized media whose upward flow is deflected by the inclined wall collides with each other at the central portion of the fluidized-bed in the fluidized-bed reactor, char is pulverized. If hard silica sand is used as a fluidized medium, pulverization of char is further accelerated.

3. Since the wastes go down into the fluidized-bed by the descending flow of the fluidized medium, solid wastes which have been coarsely crushed only can be supplied to the fluidized-bed reactor. Therefore, it is possible to dispense with pulverizing equipment, and electric power for pulverizing can be remarkably reduced.

4. Although large-sized incombustibles are generated due to coarse crushing of the wastes, such large-sized incombustibles can be easily discharged by the revolving flow of the fluidized medium from the fluidized-bed reactor.

5. Since the generated heat is dispersed by the revolving flow of the fluidized medium which is formed in overall regions of the fluidized-bed, trouble caused by generation of agglomeration or clinker can be avoided.

In case of a bubbling-type fluidized-bed which is generally used, although the fluidized medium can be uniformly fluidized in the fluidized-bed, dispersion of the fluidized medium in horizontal directions is not carried out well. Therefore, the revolving flow-type fluidized-bed reactor of the present invention is superior to the bubbling-type fluidized-bed reactor which is commonly used, with respect to the above advantages 1 through 5.

The fluidized-bed reactor of the present invention has the fluidized-bed whose temperature is in the range of 450 to 800° C. If the fluidized-bed temperature is lower than 450° C., since the reaction of thermally decomposing and gasifying the wastes would be extremely slow, undecomposed substances would be accumulated in the fluidized-bed, and an amount of produced char whose oxidization rate is slow would be increased. If the fluidized-bed temperature increases, the pyrolysis reaction of the wastes is speeded up, thereby solving the problem of the accumulation of undecomposed substances in the fluidized-bed. However, fluctuations in the feeding rate of wastes result in fluctuations in the amount of generated gas which would impair the operation of a subsequent swirling-type high-temperature combustor. This is because it is impossible to finely adjust the amount of gas supplied to the swirling-type high-temperature combustor in accordance with the amount of oxygen containing gas generated in the fluidized-bed reactor. Therefore, an upper limit for the temperature in the fluidized-bed is set to 650° C. so that the pyrolysis reaction is relatively sluggish. The fluidized-bed reactor has a larger diameter portion above the fluidized-bed which is called "freeboard". By supplying oxygen containing gas such as substantially pure oxygen or oxygen enriched air to the freeboard, the load in the subsequent high-temperature combustor can be reduced, and gasification of tar and char in the generated gas can be accelerated in the freeboard.

According to the present invention, a primary combustion of the wastes is carried out in the fluidized-bed at a temperature ranging from 450 to 650° C., and then a secondary combustion of the wastes is carried out in the freeboard at a temperature ranging from 600 to 800° C., preferably ranging from 650 to 750° C.

The fluidizing gas supplied to the fluidized-bed reactor for gasifying the wastes is selected from air, oxygen enriched air, a mixture of air and steam, a mixture of oxygen enriched air and steam, and a mixture of oxygen and steam. As a fluidized medium, sand such as silica sand or Olivine sand, alumina, iron powder, limestone, dolomite, or the like may be used.

The gases generated in the fluidized-bed reactor contain a large amount of tar and carbonous materials. The carbonous materials are crushed into powdery char in the fluidized-bed, and the powdery char and gases are introduced into the swirling-type high-temperature combustor. Since the fluidized-bed is in a reducing atmosphere, metals in the wastes can be discharged in a non-corroded condition from the fluidized-bed reactor.

The metals which can be recovered are limited to those whose melting points are lower than the gasification temperature. Therefore, in order to recover aluminum having a melting point of 660° C., it is necessary to set the temperature in the fluidized-bed to 650° C. or less.

Next, the reason why the fluidized-bed in the fluidized-bed reactor is kept at a temperature ranging from 450 to 650° C. will be described below.

Figure 4:
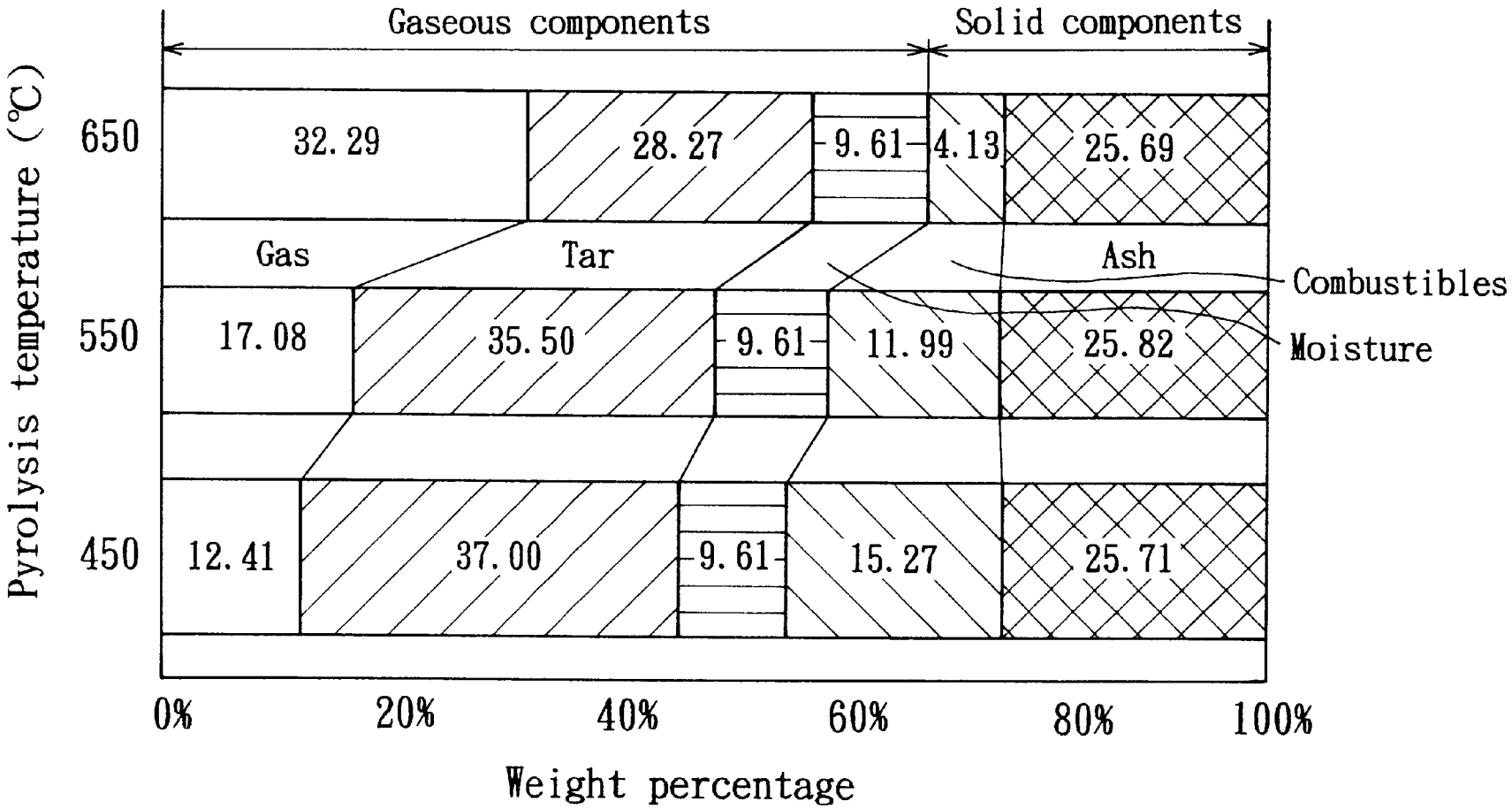
FIG. 4 is a graph showing characteristics of pyrolysis in a nitrogen atmosphere of RDF.

FIG. 4 shows the characteristics of pyrolysis in a nitrogen atmosphere of RDF. In a primary gasification process carried out in the fluidized-bed reactor, it is desirable to generate gaseous components including gas and tar as much as possible and solid components including combustible materials and ash content, that is carbonous materials, as little as possible. Char which is generated from carbonous materials in the fluidized-bed reactor and has a small diameter, is conveyed to the high-temperature combustor with an upward flow of the generated gas in the fluidized-bed reactor, but carbonous materials having a large diameter which have not been crushed well in the fluidized-bed are discharged with incombustibles from the bottom of the reactor.

If the rate of the carbonous materials is high, then the amount of the carbonous materials discharged from the bottom of the reactor must be increased to prevent the solid components from being accumulated in the fluidized-bed. Char discharged from the reactor is reused after removing sand and incombustibles therefrom, but it is desirable to reduce the amount of char discharged from the reactor.

As shown in FIG. 4, as the temperature of thermal decomposition decreases, the amount of the generated solid components increases. Further, the speed of thermal decomposition becomes extremely slow at a temperature of 450° C. or less, and undecomposed materials tend to be accumulated on the fluidized-bed, and hence operation of the fluidized-bed reactor becomes difficult. Conversely, as the temperature in the fluidized-bed increases, the amount of the generated solid components decreases, thus accelerating pyrolysis of the wastes.

However, since the wastes are supplied to the fluidized-bed reactor in almost non-crushed condition, if possible, the reaction velocity increases when the fluidized-bed temperature rises excessively. Therefore, fluctuations in the supplied rate of wastes result in fluctuations in the rate of generated gas and the internal pressure of the furnace which would impair the operation of a subsequent high-temperature combustor. It is confirmed by experiments of gasification using shredder dust of automobile wastes that if the gasification temperature is 650° C. or less, the CO content in the exhaust gas is suppressed to 10 ppm or less. Most of the wastes contain metals, and it is important to recover metals in the wastes in a non-corroded condition suitable for recycling. Among metals, recovery of aluminum is important, and in order to recover aluminum having a melting point of 660° C., it is necessary to set the temperature in the fluidized-bed to 650° C. or less.

Inasmuch as the fluidized-bed reactor is used to gasify wastes at a relatively low temperature, it is possible to treat various wastes having a size in the range of several millimeters to several centimeters. The fluidized-bed reactor has a high capacity and scale-up can be done easily. The fluidized-bed reactor is free of moving parts so that it can easily be operated for adjustment of the temperature and other parameters, and has good thermal conductivity for a heating medium to keep the temperature of the fluidized-bed uniform.

If the fluidized-bed reactor comprises a revolving flow-type fluidized-bed reactor, the wastes do not need to be crushed before being charged into the fluidized-bed reactor. The carbonous materials are effectively crushed in the fluidized-bed into char which is well dispersed in the fluidized-bed, and thus the fluidized-bed reactor has a high capacity for the wastes, can keep temperature in the fluidized-bed uniform, and has a high gasification efficiency.

Next, a high-temperature combustor will be described below. The high-temperature combustor is supplied with gaseous material and char introduced from the fluidized-bed reactor, and gasifies the gaseous material and char at a temperature of 1300° C. or higher by being contacted with gas supplied to the high-temperature combustor. Tar and char are fully gasified, and ash content therein is discharged as molten slag from the bottom of the high-temperature combustor.

The high-temperature combustor may comprise a Texaco furnace in which gaseous material and char are blown therein only from an upper part of the furnace, but may preferably comprise a swirling-type high-temperature combustor. In the swirling-type high-temperature combustor, gaseous material and char are gasified at a relatively high temperature while forming a swirling flow with gas for gasification, and ash content is melted, and then molten ash is separated and discharged therefrom.

By using the swirling-type high-temperature combustor, high load combustion and high speed combustion can be performed, distribution of the residence time of gas becomes narrow, a carbon conversion efficiency and a slag mist collecting efficiency are high, and the volume of the combustor may be small.

The gas introduced into the high-temperature combustor for gasification may be selected from oxygen enriched air and oxygen. The total amount of oxygen supplied to the fluidized-bed reactor and the high-temperature combustor may be in the range of 0.1 to 0.6 of the theoretical amount of oxygen for combustion of the wastes. The amount of oxygen supplied to the fluidized-bed reactor may be in the range of 0.1 to 0.3 of the theoretical amount of oxygen for combustion of the wastes. In this manner, fuel gas having a low calorific value ranging from 1000 to 1500 kcal/$Nm^3$ (dry) or fuel gas having a medium calorific value ranging from 2500 to 4500 kcal/$Nm^3$ (dry) can be obtained from the high-temperature combustor. According to the present invention, gas containing CO and $H_2$ as main components can be produced from the wastes, and the produced gas can be used as industrial fuel gas or synthesis for chemical industries.

Since ash content in char which is introduced into the subsequent high-temperature combustor from the fluidized-bed reactor is melted into slag in the high-temperature combustor, harmful heavy metals are fixed in the slag and will not be eluted out. Dioxins and precursors thereof, and PCB (polyclorinated biphenyl) are almost fully decomposed by the high-temperature combustion in the high-temperature combustor.

Generally, in case of producing synthesis gas for use for synthesis in chemical industries, gasification is carried out under a pressure ranging from 10 to 40 atm. However, gasification may be carried out under atmospheric pressure, and refinement of the generated gas may be carried out under a pressure ranging from 30 to 40 atm after CO conversion. As a gasifying agent used in the fluidized-bed reactor, a mixture of pure oxygen ($O_2$) obtained by low-temperature separation of air and steam is generally used, but $CO_2$ recovered by an acid gas removing process may be added to $O_2$. Nitrogen obtained by low-temperature separation of air is used in synthesis of ammonia ($NH_3$). Alternatively, oxygen enriched air may be used as a gasifying agent. By adjusting oxygen concentration so that the ratio of $H_2$ to $N_2$ is 3:1 after the CO conversion, it is possible to use the produced gas as is as synthesis gas for synthesis of ammonia. However, this method has disadvantages that flow rate of gas increases, resulting in a large-sized gas treatment equipment.

In case of using wastes as synthesis gas for synthesis of ammonia, it is necessary to deal with changes in the quality of the wastes during operation of the system.

In order to solve the above problems, according to the present invention, when the system cannot be operated stably only by using the wastes or when the system is in start-up, solid fuel such as coal or oil coke having a high calorific value and a stable property which is actually used for producing $H_2$ may be added to the wastes. That is, by adding coal or oil coke to the wastes so that it is contained in the wastes at a rate of 20 to 40%, materials for gasification can be made stable both in quality and in quantity. When the quality of the wastes is lowered due to some cause during operation, and the concentration of $H_2$ or CO in the gas is lowered, the property of the gas can be made stable by increasing the rate of supply of the solid fuel. Incidentally, the coal used in the system is not low-grade coal, which rather is comparable to the wastes, but is a sub-bituminous coal or bituminous coal having high degrees of coalification.

Various apparatuses for carrying out the method for treating wastes by gasification according to the present invention will be described below with reference to drawings.

FIG. 1 schematically shows an apparatus for carrying out the method for treating wastes by gasification according to a first embodiment of the present invention.

The apparatus shown in FIG. 1 includes a hopper 1, a screw feeder 2, and a revolving flow-type fluidized-bed reactor 3 having a fluidized-bed 4 therein. The fluidized-bed reactor 3 has a freeboard 5 and a burner 6, and is connected to a trommel 7 which is associated with a bucket conveyor 8. The apparatus further includes a swirling-type high-temperature combustor 9 having a primary combustion chamber 10, a secondary combustion chamber 11 and a slag separation chamber 12. The swirling-type high-temperature combustor 9 has burners 13. In FIG. 1, the symbols b, b', b" and c represent organic wastes, air for the fluidized-bed 4, air for the freeboard 5, air for the high-temperature combustor 9, and large-sized incombustibles, respectively. Further, the symbols d, e, e' and f represent silica sand, generated gas, combustion exhaust gas, and slag, respectively.

Wastes "a" are supplied to the hopper 1, and then supplied at a constant rate by the screw feeder 2 to the fluidized-bed reactor 3. Air "b" is introduced as a gasifying agent into the fluidized-bed reactor 3 from a bottom thereof, forming a fluidized-bed 4 of the fluidized medium made of silica sand over a dispersion plate in the fluidized-bed reactor 3.

The fluidizing gas having a relatively low fluidizing gas velocity is supplied into the central part of the fluidized-bed 4, and the fluidizing gas having a relatively high fluidizing gas velocity is supplied into the peripheral part of the fluidized-bed 4, thus forming revolving flows of the fluidized medium in the fluidized-bed reactor 4 as shown in FIG. 1.

The organic wastes "a" are charged into the fluidized-bed 4, contacted with $O_2$ in the air within the fluidized-bed 4 which is kept at a temperature ranging from 450 to 650° C., and quickly pyrolized. The fluidized medium in the fluidized-bed 4 and incombustibles are discharged from the bottom of the fluidized-bed reactor 3 and enter the trommel 7 by which the incombustibles "c" are removed. The separated silica sand "d" is charged back through the bucket conveyor 8 into the fluidized-bed reactor 3 from an upper end thereof. The discharged incombustibles "c" contain metals. Since the fluidized-bed 4 is kept at a temperature ranging from 450° C. to 650° C., iron, copper and aluminum can be recovered in a non-corroded condition suitable for recycling.

When the wastes "a" are gasified in the fluidized-bed 4, gas, tar and carbonous materials are generated. The gas and tar are atomized and ascend in the fluidized-bed reactor 3. The carbonous materials are pulverized into char by a stirring action of the fluidized-bed 4. Since the char is porous and light, it is carried with the upward flow of the generated gas. Since the fluidized medium of the fluidized-bed 3 comprises hard silica sand, the pulverization of the carbonous materials is accelerated. Air "b" is blown into the freeboard 5 to gasify the gas, tar, and char at a temperature ranging from 600° C. to 800° C. for thereby accelerating conversion of gas components into low molecular components and gasification of tar and char.

The generated gas "e" discharged from the fluidized-bed reactor 3 is supplied into the primary combustion chamber 10 of the swirling-type high-temperature combustor 9, and combusted at a high temperature of 1300° C. or higher while being mixed with preheated air "b" in a swirling flow thereof. The combustion is completed in the secondary combustion chamber 11, and the generated exhaust gas "e" is discharged from the slag 25 separation chamber 12. Because of the high temperature in the swirling-type high-temperature combustor 9, ash content in the char is converted into slag mist which is trapped by molten slag phase on an inner wall of the primary combustion chamber 10 under the centrifugal forces of the swirling flow. The molten slag flows down on the inner wall and enters the secondary combustion chamber 11, from which slag "f" is discharged through a bottom of the slag separation chamber 12. The primary and secondary combustion chambers 10 and 11 are provided with the respective burners 13 for start-up. In this manner, combustion is carried out at an air ratio of about 1.3, and melting of ash content and forming of slag thereof are carried out.

Figure 2:
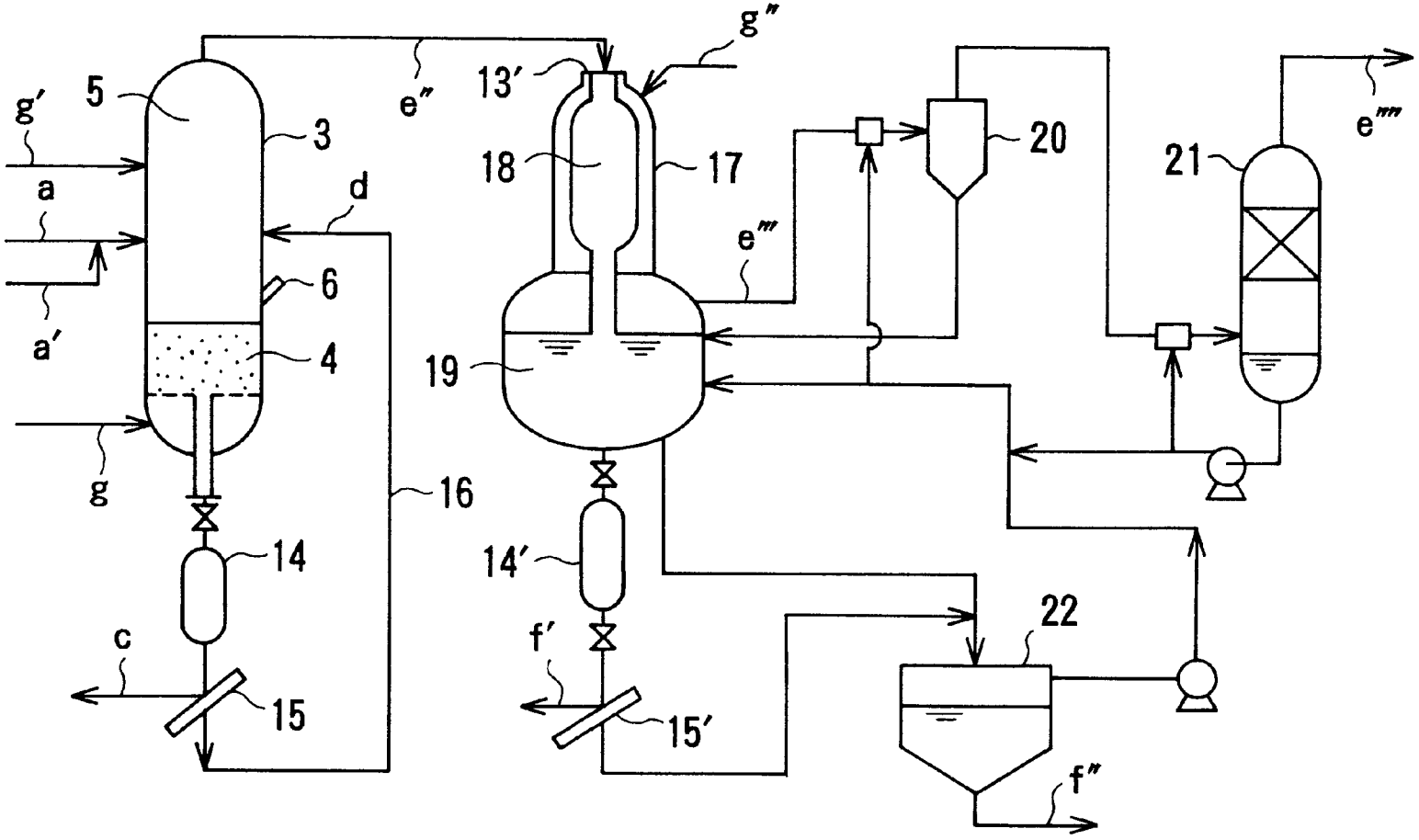
FIG. 2 is a schematic diagram of an apparatus for carrying out the treating method according to a second embodiment of the present invention.

FIG. 2 shows an apparatus for carrying out the method for treating wastes by gasification according to a second embodiment of the present invention.

The apparatus shown in FIG. 2 serves to produce synthesis gas having a high pressure ranging from 10 to 40 atm.

The apparatus comprises a revolving flow-type fluidized-bed reactor 3 and a swirling-type high-temperature combustor 17. The fluidized-bed reactor 3 is connected to a rock hopper 14 which is associated with a screen 15. The swirling-type high-temperature combustor 17 is also connected to a rock hopper 14' which is associated with a screen 15'. The screen 15 is connected to the fluidized-bed reactor 3 through a fluidized medium circulation line 16. The swirling-type high-temperature combustor 17 has a high-temperature gasification chamber 18 and a quenching chamber 19 therein. The swirling-type high-temperature combustor 17 is connected to a cyclone 20 is connected to a scrubber 21. A settler 22 which is associated with the high-temperature combustor 17. In FIG. 2, "a'" represents coal or oil coke for supplementary fuel, "g" and "g'" represent a mixture of $O_2$ and $H_2O$ as a gasifying agent, and "g"" represents $O_2$ as a gasifying agent.

Wastes "a" are supplied at a constant rate through a rock hopper or the like to the fluidized-bed reactor 3. A mixture of $O_2$ and $H_2O$ is introduced as a gasifying agent "g" into the fluidized-bed reactor 3 from a bottom thereof, forming a fluidized-bed 4 of the fluidized medium made of silica sand over a dispersion plate in the fluidized-bed reactor 3. The wastes "a" are charged into the fluidized-bed 4 and contacted with the gasifying agent "g" within the fluidized-bed 4 which is kept at a temperature ranging from 450 to 650° C. and under a pressure ranging from 10 to 40 atom, and are rapidly pyrolized. The fluidized medium in the fluidized-bed 4 and incombustibles are discharged from the bottom of the fluidized-bed reactor 3, pass through the rock hopper 14, and then are supplied to the screen 15 by which the incombustibles "c" are separated. The silica sand "d" is charged back through the fluidized medium circulation line 16 into the fluidized-bed reactor 3. The discharged incombustibles "c"

contain metals. Since the fluidized-bed 4 is kept at a temperature ranging from 450 to 650° C., iron, copper and aluminum can be recovered in a non-corroded condition suitable for recycling.

When the wastes "a" are gasified in the fluidized-bed 4, gas, tar and carbonous materials are generated. The gas and tar are vaporized and ascend in the fluidized-bed reactor 3. The carbonous materials are pulverized into char by a vigorous revolving action of the fluidized-bed 4. Since the char is porous and light, it is carried with the upward flow of the generated gas. Since the fluidized medium of the fluidized-bed 4 comprises hard silica sand, the pulverization of the carbonous materials is accelerated. A gasifying agent "g'" comprising a mixture of $O_2$ and $H_2O$ is blown into the freeboard 5 to gasify the gas, tar and char at a temperature ranging from 600 to 800° C. for thereby accelerating conversion of gas components into low-molecular components and gasification of tar and char.

The generated gas "e'"" discharged from the fluidized-bed reactor 3 is supplied into the high-temperature gasification chamber 18 of the swirling-type high-temperature combustor 17, and combusted at a high temperature 1300° C. or higher while being mixed with preheated gasifying agent "g'"" in a swirling flow thereof. Because of the high temperature in the swirling-type high-temperature combustor 17, ash content in the gas is converted into slag mist which enters the quenching chamber 19 with the gas to be contacted with water directly. In the quenching chamber 19, the slag is quenched into granulated slag, and the granulated slag is discharged through the rock hopper 14' to the outside of the high-temperature combustor 17, and then classified into course grain slag "f'" and fine grain slag "f'"" by the screen 15'.

The generated gas is discharged from the high-temperature combuster 17, and supplied to the scrubber 21 through the cyclone 20. In the scrubber 21, the gas is scrubbed to thus produce refined gas.

Figure 3:
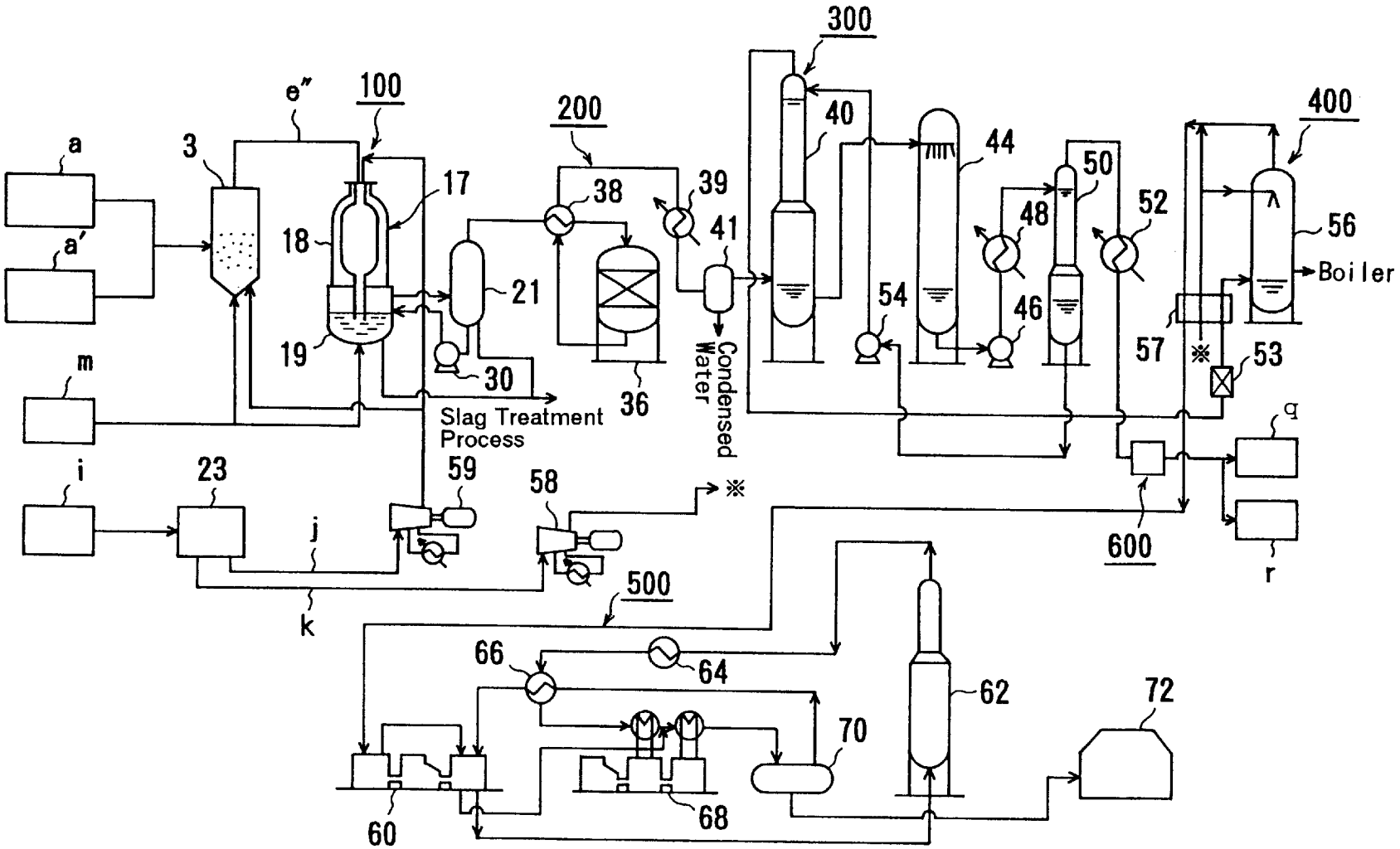
FIG. 3 is a flow diagram showing a process for synthesizing ammonia ($NH_3$) from the wastes according to an embodiment of the present invention.

FIG. 3 is a flow diagram showing a process for synthesizing ammonia ($NH_3$) from organic wastes according to an embodiment of the present invention.

As shown in FIG. 3, the process comprises a step 100 of gasification, a step 200 of carbon monoxide conversion, a step 300 of removing acidic gas, a step 400 of gas refining with liquid nitrogen, a step 500 of synthesizing ammonia, and a step 600 of recovering sulfur. An apparatus for carrying out the above process includes a gas scrubber 21, a low-temperature air separator 23, a fluidized-bed reactor 3 for carrying out a primary gasification of organic wastes, a high-temperature combustor 17 for carrying out a secondary gasification at a relatively high temperature, a carbon monoxide converter 36, an absorption tower 40, a condensate tank 41, a carbon dioxide stripping tower 44, a hydrogen sulfide stripping tower 50, an adsorption tower 53, a liquid nitrogen cleaning tower 56, and a cooler 57. The apparatus further includes a compressor 58 for compressing gaseous nitrogen, a compressor 59 for compressing gaseous oxygen, a compressor 60 for compressing synthesis gas, an ammonia synthesis tower 62, an ammonia refrigerator 68, an ammonia separator 70, and an ammonia storage tank 72. The apparatus further includes heat exchangers 38, 39, 48, 52, 64 and 66, and pumps 30, 46 and 54. In FIG. 3, the symbols i, j, q and r represent air, oxygen ($O_2$) , sulfur (S) and ammonium sulfite, respectively.

Air "i" is separated into oxygen "j" and nitrogen "k" by the air separator 23. The separated oxygen is compressed by the compressor 59, and supplied to the fluidized-bed reactor 3 and the high-temperature combustor 17 as a gasifying agent. The nitrogen "k" is compressed by the compressor 58, and used as gas for synthesis of ammonia. A low-temperature separation method is generally used for separating air.

In the gasification step 100, organic wastes "a" and a supplementary material "a'" are treated at a relatively low temperature in the fluidized-bed reactor 3, and then treated in the high-temperature combustor 17 at a temperature ranging from 1200 to 1500° C and under a pressure ranging from 10 to 40 kg/cm$^2$ G to generate gas containing CO, $H_2$, $H_2O$ and CO as main components. The temperature in the high-temperature combustor 17 is mainly adjusted by controlling the amount of oxygen. The high-temperature combustor 17 is of a direct-quench system, and has a high-temperature gasification chamber 18 at an upper part thereof and a quenching chamber 19 at a lower part thereof. The generated gas is quenched in direct contact with a water in the quenching chamber 19, and then discharged from the high-temperature combustor 17. By this quenching, a large amount of steam is generated, the generated steam flows with the generated gas, and most of slag generated in the high-temperature gasification chamber 18 is removed. The slurry of the slag and water is supplied to a slag treatment process. The generated gas, which is accompanied by the large amount of steam when being discharged from the quenching chamber 19, is cleaned in a venturi scrubber (not shown) and the gas scrubber 21 to remove the slag mist therefrom. Thereafter, the generated gas is supplied to the step 200 of carbon monoxide conversion. The scrubbing water in the bottom of the gas scrubber 21 is mainly supplied to the quenching chamber 19 by the pump 30 for circulation, and the part of the scrubbing water is supplied to the slag treatment process.

In the step 200 of carbon monoxide conversion, the generated gas containing steam and supplied from the gasification step 100 is used as synthesis gas. The gas from the gas scrubber 21 is heated to a temperature suitable for carbon monoxide conversion by heat exchange with a gas passing through a first-stage catalyst bed in the heat exchanger 38, and then is supplied to the carbon monoxide converter 36. In the carbon monoxide converter 36, carbon monoxide (CO) in the gas reacts with the accompanied steam in the presence of a carbon monoxide conversion catalyst to produce hydrogen ($H_2$). The carbon monoxide converter 36 comprises two-stage catalyst beds composed of Co—Mo catalyst. The temperature at an inlet of the first-stage catalyst bed is approximately 300° C. The molar ratio of steam to dry generated gas is approximately 1.5. The temperature at an exit of the first-stage catalyst bed is not allowed to exceed 480° C.

The temperature at an inlet of the second-stage catalyst bed is approximately 300° C. The conversion ratio is 90% or more, and the concentration of carbon monoxide in the dry gas at the exit of the carbon monoxide converter 36 is 2% or less. The carbon monoxide conversion reaction is expressed by the following formula:

$$CO+H_2O=CO_2+H_2$$

This reaction is an exothermic reaction, and the high-temperature gas passing through the first-stage catalyst bed is cooled by heat exchange with a gas from the inlet of the carbon monoxide converter 36, and then enters the second-stage catalyst bed. In the second-stage catalyst bed, the carbon monoxide conversion reaction proceeds further.

The gas passing through the carbon monoxide converter 36 is cooled by the heat exchanger 39 to approximately 40° C., and separated in the condensate tank 41 into condensed water and gas, and then is cooled to −17° by heat exchange with a part of purified gas from the top of the nitrogen cleaning tower 56. Thereafter, the cooled gas is supplied to the step 300 of removing acidic gas in which a physical adsorption process, i.e. Rectisol process, is carried out to remove impurities including hydrogen sulfide ($H_2S$), carbonyl sulfide (COS) and carbon dioxide ($CO_2$), from the converted gas supplied from the carbon monoxide conversion step 200.

The gas cooled to −17° C. is introduced into the absorption tower 40 in which carbon dioxide ($CO_2$) is absorbed by being contacted countercurrently with liquid methanol of approximately −60° C. As a result, the gas discharged from the absorption tower 40 has a carbon dioxide ($CO_2$) concentration ranging from 10 to 20 ppm and a hydrogen sulfide ($H_2S$) concentration of approximately 0.1 ppm. As methanol used as an absorption liquid absorbs carbon dioxide, the temperature of the methanol increases, and the absorption ability thereof is lowered. Therefore, the methanol is drawn from the absorption tower 40, cooled by ammonia as a coolant and then returned to the absorption tower 40.

A small amount of hydrogen ($H_2$) and carbon monoxide (CO) in addition to carbon dioxide ($CO_2$) and hydrogen sulfide ($H_2S$) are dissolved in the methanol drawn from the absorption tower 40. In order to recover hydrogen ($H_2$) and carbon monoxide (CO) from the methanol, the methanol is treated under reduced pressure in a methanol regeneration tower (not shown) to release hydrogen ($H_2$) and carbon monoxide (CO) therefrom. The released hydrogen and carbon monoxide are compressed by a compressor, and used for recirculation. On the other hand, in order to recover carbon dioxide ($CO_2$) of high purity which is absorbed by the methanol, the methanol is supplied to the carbon dioxide stripping tower 44, and depressurized therein and stripped by gaseous nitrogen, whereby carbon dioxide ($CO_2$) in the methanol is released and the released carbon dioxide is recovered.

The methanol containing condensed hydrogen sulfide ($H_2S$) is taken out from the bottom of the carbon dioxide stripping tower 44 and supplied to the heat exchanger 48 by the pump 46. After being heated in the heat exchanger 48, the methanol is supplied to the hydrogen sulfide stripping tower 50 in which it is indirectly regenerated by steam. Hydrogen sulfide enriched gas discharged from the top of the hydrogen sulfide stripping tower 50 is cooled in the heat exchanger 52, and then supplied to the step 600 of recovering sulfur in which sulfur "q" or ammonium sulfite "r" is recovered. The methanol drawn from the bottom of the hydrogen sulfide stripping tower 50 is supplied to the top of the absorption tower 40 by the pump 54 for recirculation.

Hydrogen enriched gas supplied from the absorption tower 40 which contains a small amount of carbon monoxide (CO) and a trace amount of carbon dioxide ($CO_2$) passes through the adsorption tower 53 to allow methanol and carbon dioxide to be removed therein, and is cooled to approximately −190° C. by the cooler 57, and then supplied to the liquid nitrogen cleaning tower 56. In the step 400 of gas refining with liquid nitrogen, the supplied gas containing a trace amount of carbon monoxide (CO) and methane ($CH_4$) is cleaned with supercooled liquid nitrogen to thereby remove carbon monoxide and methane. Gaseous hydrogen is not absorbed by the liquid nitrogen because hydrogen has a lower boiling point than nitrogen. Therefore, purified hydrogen enriched gas containing nitrogen is obtained from the top of the nitrogen cleaning tower 56.

The purified gas discharged from the top of the liquid nitrogen cleaning tower 56 is mixed with gaseous nitrogen having high pressure which is generated from the liquid nitrogen cooled by the cooler 57 so that the molar ratio of hydrogen to nitrogen is adjusted to a suitable value, i.e., approximately 3 suitable for ammonia synthesis, and the mixed gas is heated by passing again through the cooler 57 and supplied to the step 500 for synthesizing ammonia. A part of nitrogen gas compressed by the compressor 58 is cooled and liquefied by the cooler 57, and supplied to the nitrogen cleaning tower 56, in which the supplied nitrogen gas contacts with the gas supplied from the bottom of the nitrogen cleaning tower 56 countercurrently, and impurities including carbon monoxide (CO), argon (Ar) and methane ($CH_4$) in the supplied gas are absorbed with liquid nitrogen, and removed. The liquid nitrogen which has absorbed the impurities such as carbon monoxide (CO), argon (Ar) and methane ($CH_4$) is drawn from the bottom of the nitrogen cleaning tower 56, and depressurized and used as a fuel for a boiler. The gas supplied from the cleaning step 400 is compressed to a pressure of, for example, 150 kg/cm$^2$ G in the first-stage of the compressor 60, and then the compressed gas is mixed with the recirculating gas from the ammonia separator 70. Thereafter, the mixed gas is compressed to a pressure of 165 kg/cm$^2$ G in the second-stage of the compressor 60, and then supplied to the ammonia synthesis tower 62. The ammonia synthesis tower has two-stage catalyst beds composed of Fe catalyst. The gas at an inlet of the ammonia synthesis tower 62 has a pressure of 164 kg/cm$^2$ and a temperature of 250° C. The ammonia synthesis reaction is carried out when the synthesis gas passes through the catalyst beds. The reaction is expressed by the following formula:

$$N_2+3H_2=2NH_3$$

The gas which has passed through the catalyst beds has a temperature exceeding 500° C., however, it is cooled by the cooled gas introduced into the ammonia synthesis tower 62.

The ammonia discharged from the ammonia synthesis tower 62 has a pressure of 160 kg/cm$^2$ G and a temperature of 450° C. The ammonia is cooled to around room temperature by the heat exchangers 64 and 66, and further cooled by the ammonia refrigerator 68, thus most of ammonia is condensed. The condensed ammonia is separated into liquid ammonia and gas, and the liquid ammonia is fed to the ammonia storage tank 72. The separated gas is supplied to the second-stage of the compressor 60 by which it is compressed to a pressure of 165 kg/cm$^2$ G, and then the compressed gas is supplied to the ammonia synthesis tower 62 for recirculation.

As described above, the method and apparatus for treating wastes by gasification according to the present invention offers the following advantages:

1. Hydrogen which is a material for ammonia ($NH_3$) can be produced from organic wastes which are readily available locally. Thus, the production cost of ammonia is greatly reduced.

2. By gasifying the organic wastes to produce hydrogen, various problems caused by conventional incineration treatment can be solved. To be more specific, the amount of exhaust gas is greatly reduced, and dioxins and precursor thereof are not generated. Further, since ash content in the wastes is converted into harmless slag, a life of reclaimed land can be prolonged, and the recovered slag can be utilized as pavement materials.

3. Metals such as iron, copper or aluminum can be recovered in a non-corroded condition suitable for recycling.

From the viewpoint of effective utilization of the wastes and environmental conservation, gasification facilities for gasifying organic wastes and ammonia synthesis facilities are constructed adjacently to each other, and combined organically with respect to utilization of materials to enhance functions of both facilities as a total system.

4. By supplying supplementary fuel such as coal or oil coke, it is possible to deal with fluctuations of the wastes both in quality and in quantity. Particularly, the gasification facilities can be operated stably to counteract deterioration in properties of produced gas by increasing the mixing ratio of the solid fuel.

Although certain preferred embodiments of the present invention have been shown and described in detail, it should be understood that various changes and modifications may be made thereto without departing from the scope of the appended claims.

What is claimed is:

1. A method of treating wastes, said method comprising:

gasifying by partially combusting said wastes in a fluidized bed reactor at a temperature of from 450° C. to 650° C., and thereby forming gaseous material and carbonous material, while crushing said carbonous material by a fluidized bed in said fluidized bed reactor to thereby form char;

discharging said gaseous material and said char from said fluidized bed reactor and introducing the thus discharged gaseous material and char into a combustor that is separate from said fluidized bed reactor and that is operated at a temperature sufficient to melt an ash content of said char, and therein gasifying said gaseous material and said char to form synthesis gas, while melting said ash content to thereby form molten slag;

conducting said gasifying in said fluidized bed reactor and in said combustor at a pressure elevated above atmospheric pressure;

transfer of said gaseous material and said char from said fluidized bed reactor to said combustor being conducted without the use of a compressor;

removing said molten slag from said combustor;

cooling said synthesis gas to thereby form cooled synthesis gas;

converting CO and $H_2O$ in said cooled synthesis gas to $CO_2$ and $H_2$; and removing said $CO_2$ and recovering said $H_2$.

2. A method as claimed in claim 1, further comprising operating said fluidized bed to form a revolving flow of fluidized medium in such a manner that said fluidized medium descends in a first region of said fluidized bed, ascends in a second region of said fluidized bed, moves from said first region toward said second region in a lower portion of said fluidized bed, and moves from said second region toward said first region in an upper portion of said fluidized bed.

3. A method as claimed in claim 1, further comprising forming said gaseous material and said char into a swirling flow in said combustor.

4. A method as claimed in claim 1, further comprising introducing oxygen-containing gas and steam as a gasifying agent into at least one of said fluidized bed reactor and said combustor.

5. A method as claimed in claim 1, further comprising separating air into oxygen and nitrogen.

6. A method as claimed in claim 5, further comprising employing said oxygen as a gasifying agent in at least one of said fluidized bed reactor and said combustor.

7. A method as claimed in claim 5, further comprising employing said nitrogen with said $H_2$ for synthesis of ammonia.

8. A method as claimed in claim 1, further comprising introducing oxygen enriched air as a gasifying agent into at least one of said fluidized bed reactor and said combustor.

9. A method as claimed in claim 8, further comprising controlling the oxygen concentration of said oxygen enriched air so that a ratio of hydrogen gas to nitrogen gas obtained after said converting is 3:1.

10. A method as claimed in claim 1, further comprising introducing an oxygen-containing gas as a gasifying agent into said fluidized bed reactor and said combustor, and controlling the oxygen concentration of said oxygen-containing gas to be from 0.1 to 0.6 of the theoretical amount of oxygen required for combustion of said wastes.

11. A method as claimed in claim 10, comprising controlling the oxygen concentration of said oxygen-containing gas introduced into said fluidized bed reactor to be from 0.1 to 0.3 of the theoretical amount of oxygen required for combustion of said wastes.

12. A method as claimed in claim 1, further comprising employing at least one of sand, alumina, limestone and dolomite as a fluidized medium of said fluidized bed.

13. A method as claimed in claim 1, wherein said partially combusting in said fluidized bed reactor includes primary and secondary combustions, and said gasifying in said combustor comprises a tertiary combustion.

14. A method as claimed in claim 1, wherein said pressure comprises 10 to 40 atmospheres.

15. A method as claimed in claim 1, wherein said pressure comprises 30 to 40 atmospheres.

16. A method as claimed in claim 1, wherein said temperature sufficient to melt said ash content of said char is at least 1300° C., and said removing said molten slag from said combustor and said cooling said synthesis gas to thereby form cooled synthesis gas are conducted by quenching said synthesis gas and said molten slag by introducing said synthesis gas and said molten slag directly into a liquid bath in a quenching chamber.

17. A method as claimed in claim 16, wherein said combustor includes a gasifying chamber and a quenching chamber, said gasifying said gaseous material and said char is conducted in said gasifying chamber, and said quenching is conducted in said quenching chamber.

18. A method as claimed in claim 16, wherein a portion of said $H_2O$ comprises steam generated by said quenching.

19. A method as claimed in claim 16, further comprising operating said fluidized bed to form a revolving flow of fluidized medium in such a manner that said fluidized medium descends in a first region of said fluidized bed, ascends in a second region of said fluidized bed, moves from said first region toward said second region in a lower portion of said fluidized bed, and moves from said second region toward said first region in an upper portion of said fluidized bed.

20. A method as claimed in claim 16, further comprising forming said gaseous material and said char into a swirling flow in said combustor.

21. A method as claimed in claim 16, further comprising introducing oxygen-containing gas and steam as a gasifying agent into at least one of said fluidized bed reactor and said combustor.

22. A method as claimed in claim 16, further comprising separating air into oxygen and nitrogen.

23. A method as claimed in claim 22, further comprising employing said oxygen as a gasifying agent in at least one of said fluidized bed reactor and said combustor.

24. A method as claimed in claim 22, further comprising employing said nitrogen with said $H_2$ for synthesis of ammonia.

25. A method as claimed in claim 16, further comprising introducing oxygen enriched air as a gasifying agent into at least one of said fluidized bed reactor and said combustor.

26. A method as claimed in claim 25, further comprising controlling the oxygen concentration of said oxygen enriched air so that a ratio of hydrogen gas to nitrogen gas obtained after said converting is 3:1.

27. A method as claimed in claim 16, further comprising introducing an oxygen-containing gas as a gasifying agent into said fluidized bed reactor and said combustor, and controlling the oxygen concentration of said oxygen-containing gas to be from 0.1 to 0.6 of the theoretical amount of oxygen required for combustion of said wastes.

28. A method as claimed in claim 27, comprising controlling the oxygen concentration of said oxygen-containing gas introduced into said fluidized bed reactor to be from 0.1 to 0.3 of the theoretical amount of oxygen required for combustion of said wastes.

29. A method as claimed in claim 16, further comprising employing at least one material selected from the group consisting of sand, alumina, limestone and dolomite as a fluidized medium of said fluidized bed.

30. A method as claimed in claim 16, wherein said partially combusting in said fluidized bed reactor includes primary and secondary combustions, and said gasifying in said combustor comprises a tertiary combustion.

31. A method as claimed in claim 16, wherein said pressure comprises 10 to 40 atmospheres.

32. A method as claimed in claim 16, wherein said pressure comprises 30 to 40 atmospheres.

33. A method as claimed in claim 1, wherein said temperature of said gasifying in said fluidized bed reactor is less than 650° C.

* * * * *